US009478191B2

(12) United States Patent
Lee et al.

(10) Patent No.: US 9,478,191 B2
(45) Date of Patent: Oct. 25, 2016

(54) DISPLAY DEVICE AND METHOD OF DRIVING THE SAME

(71) Applicant: SAMSUNG DISPLAY CO., LTD., Yongin, Gyeonggi-Do (KR)

(72) Inventors: Jongjin Lee, Yongin-si (KR); Jinkyu Park, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 113 days.

(21) Appl. No.: 14/462,026

(22) Filed: Aug. 18, 2014

(65) Prior Publication Data

US 2015/0221061 A1 Aug. 6, 2015

(30) Foreign Application Priority Data

Feb. 4, 2014 (KR) ..... 10-2014-0012715

(51) Int. Cl.

| | |
|---|---|
| ***G09G 5/39*** | (2006.01) |
| ***G09G 5/00*** | (2006.01) |
| ***G09G 3/20*** | (2006.01) |
| *G09G 3/36* | (2006.01) |

(52) U.S. Cl.

CPC ..... *G09G 5/008* (2013.01); *G09G 3/2092* (2013.01); *G09G 5/005* (2013.01); *G09G 3/3648* (2013.01); *G09G 2320/103* (2013.01); *G09G 2330/021* (2013.01); *G09G 2340/0435* (2013.01)

(58) Field of Classification Search

CPC ..... G09G 2320/103; G09G 2330/021; G09G 2360/18; G09G 2330/022; G09G 3/3618; G09G 5/008; G06F 1/32; G06F 1/3265

See application file for complete search history.

(56) References Cited

U.S. PATENT DOCUMENTS

| | | | | |
|---|---|---|---|---|
| 2012/0146968 | A1 | 6/2012 | Glen | |
| 2012/0242671 | A1 | 9/2012 | Wyatt | |
| 2013/0027379 | A1 | 1/2013 | Lee et al. | |
| 2013/0235055 | A1* | 9/2013 | Kim | G09G 5/006 345/545 |
| 2013/0235941 | A1 | 9/2013 | Koo et al. | |
| 2013/0278591 | A1* | 10/2013 | Moon | G09G 3/3618 345/214 |

FOREIGN PATENT DOCUMENTS

| | | | |
|---|---|---|---|
| JP | 2006-171737 | A | 6/2006 |
| JP | 2013-126118 | A | 6/2013 |
| KR | 101158876 | B1 | 6/2012 |

* cited by examiner

*Primary Examiner* — Hau Nguyen
(74) *Attorney, Agent, or Firm* — Cantor Colburn LLP

(57) ABSTRACT

A display device includes: a system unit which output image signals corresponding to frames and a first or second image control signal based on the image signals; an eDP reception unit which receives the image signals and the first or second image control signal from the system unit, provides a still image signal based on the first image control signal, and provides the image signals based on the second image control signal; and a frame memory which stores the still image signal and outputs the still image signal while the first image control signal is provided to the eDP reception unit, where the still image signal is one of the image signals; the eDP reception unit recovers first clock signals based on the image signals; and the frame memory outputs the still image signal based on a second clock signal generated based on the first clock signal.

16 Claims, 6 Drawing Sheets

DISPLAY DEVICE AND METHOD OF DRIVING THE SAME

This application claims priority to Korean Patent Application No. 10-2014-0012715, filed on Feb. 4, 2014, and all the benefits accruing therefrom under 35 U.S.C. §119, the content of which in its entirety is herein incorporated by reference.

BACKGROUND

The disclosure relates to a display device, and more particularly, to a panel self-refresh based display device and a method of driving the panel self-refresh based display device.

Recently, as display devices have a larger display area and a higher resolution, high performance of an interface for signal transmission between a video source and a display device is required. Accordingly, in the case of a television ("TV"), Vxl is widely used as the interface, and in the case of information technology ("IT") products such as a notebook computer, a display port ("DP") is widely used as the interface. The DP interface, as an interface defined by Video Electronics Standards Association ("VESA"), is an interface integrating low voltage differential signaling ("LVDS"), i.e., existing internal interface standard, and a digital visual interface ("DVI"), i.e., external connection standard, into one.

The DP interface provides a digital internal connection between a chip and a chip, and a digital external connection between a product and a product. As two separate interfaces are integrated into one, the DP interface may support color depth and resolution with a broader data bandwidth.

Recently, VESA announces the new version of the embedded display port ("eDP") standard. The eDP standard is an interface standard corresponding to the DP interface designed for devices including display devices such as laptop computers, personal computers ("PC"s), and tablets. Especially, the eDP uses a panel self-refresh ("PSR") technique. The PSR technique is suggested to improve system power saving performance and to thereby increase battery life. That is, the PSR technique minimizes power consumption by utilizing a memory embedded in a display but displays an image as it is. Accordingly, battery usage time may be increased in a portable PC environment.

SUMMARY

The disclosure provides a display device with improved driving performance with PSR technique.

Exemplary embodiments of the invention provide a display device including: a system unit which output a plurality of image signals corresponding to a plurality of frames and a first or second image control signal based on the image signals; an embedded display port ("eDP") reception unit which receives the image signals and the first or second image control signal from the system unit, provides a still image signal based on the first image control signal, and provides the image signals based on the second image control signal; and a frame memory which stores the still image signal from the eDP reception unit and outputs the still image signal while the first image control signal is provided to the eDP reception unit, where the still image signal is one image signal of the image signals; the eDP reception unit recovers first clock signals based on the image signals corresponding to the frames; and the frame memory outputs the still image signal based on a second clock signal, wherein the second clock signal is generated based on the first clock signal.

In an exemplary embodiment, the system unit may include: a central processing device which provides the image signals to correspond to the frames; a panel self-refresh ("PSR") control unit which generates the first or second image control signal based on the image signals; and an eDP transmission unit which is turned off in response to the first image control signal and provides the image signals to the eDP reception unit in response to the second image control signal.

In an exemplary embodiment, the PSR control unit may generate the first image control signal when the image signals received during a predetermined number of consecutive frames are the same as each other.

In an exemplary embodiment, the PSR control unit may generate the second image control signal when the image signals received during a predetermined number of consecutive frames are different from each other.

In an exemplary embodiment, the eDP reception unit may include a clock recovery unit, where the clock recovery unit may recover the first clock signals based on the image signals corresponding to the frames while the second image control signal is provided to the eDP reception unit.

In an exemplary embodiment, the device may further include a frame buffer which stores the first clock signals corresponding to the image signals while the second image control signal is provided to the eDP reception unit.

In an exemplary embodiment, the device may further include a clock conversion unit which generates a clock conversion signal based on the first clock signals stored in the frame buffer.

In an exemplary embodiment, the clock conversion unit may calculate an average frequency based on frequencies of the first clock signals and may generate the clock conversion signal based on the calculated average frequency.

In an exemplary embodiment, the clock conversion unit may generate the clock conversion signal based on a clock signal of an image signal, which is provided before the first image controls signal is generated, among the image signals.

In an exemplary embodiment, the device may further include a clock unit which generates the second clock signal based on the clock conversion signal, where the frame memory may provide the still image signal based on the second clock signal.

In an exemplary embodiment, the device may further include a timing logic unit which receives the image signals from the eDP reception unit and receives the still image signal from the frame memory, where the timing logic unit may convert a data format of the image signals or the still image signal based on a control signal from the system unit.

In an exemplary embodiment, the device may further include a display unit which displays an image based on the converted image signals or the converted still image signal from the timing logic unit.

In an exemplary embodiment, when the first image control signal is provided to the eDP reception unit, the frame memory may store an image signal of a frame, which is provided to the eDP reception unit before the first image control signal is provided thereto.

In an exemplary embodiment, the first image signals may be in synchronization with the first clock signal.

In another exemplary embodiment of the invention, a method of driving a display device includes: outputting a plurality of image signals corresponding to a plurality of frames and a first and second image control signal from a system unit to an embedded display port ("eDP") reception unit of the display device; providing a still image signal from the eDP reception unit to a display unit based on the first image control signal; and providing the image signals to the display unit based on the second image control signal, where the still image signal is one image signal of the image signals; first clock signals are recovered based on the image signals corresponding to the frames, the still image signal is outputted based on a second clock signal, and the second clock signal is generated based on the first clock signal.

In an exemplary embodiment, the second clock signal may be generated based on an average frequency calculated based on frequencies of the first clock signals.

In an exemplary embodiment, the second clock signal may be generated based on a first clock signal of the first clock signals, which is provided before the first image control signal is generated.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
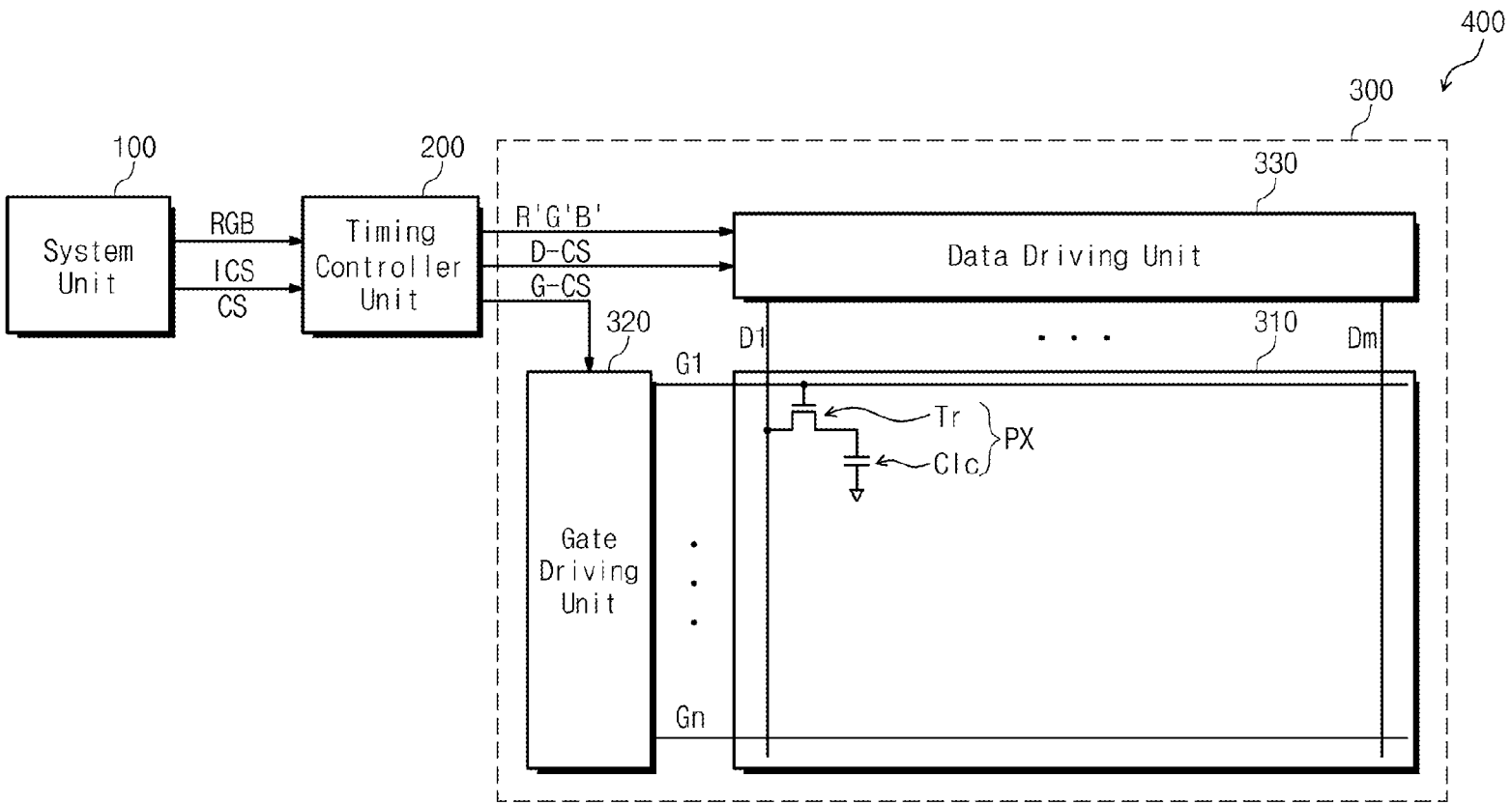
FIG. 1 is a block diagram illustrating an exemplary embodiment of a display device according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in detail with reference to the accompanying drawings.

FIG. 1 is a block diagram illustrating an exemplary embodiment of a display device according to the invention.

Referring to FIG. 1, an exemplary embodiment of the display device 400 includes a system unit 100, a timing controller unit 200 and a display unit 300.

According to an exemplary embodiment of the invention, the system unit 100 and the timing controller unit 200 may include an embedded display port ("eDP"). In such an embodiment, the display device 400 may use an eDP interface based panel self-refresh technique to reduce power consumption.

The system unit 100 may provide the timing controller unit 200 with an image signal RGB of each frame for displaying an image and an image control signal ICS for determining whether a still image is provided from the display unit 300.

In such an embodiment, the system unit 100 determines that the image is stationary when the same image signal is provided continuously during a predetermined number of frames, that is, the image signal provided during a predetermined number of consecutive frames are the same as each other, where the predetermined number is greater than a reference value. Here, the reference value is defined when the same image is generated in more than two frames. In one exemplary embodiment, for example, the reference value is 2, and it is determined that an image is stationary when the same image signal is generated continuously in two frames.

According to an exemplary embodiment of the invention, when it is determined that an image is stationary, the system unit 100 provides the image control signal ICS to the timing controller unit 200. In such an embodiment, when it is determined that an image is not stationary, the system unit 100 does not provide the image control signal ICS to the timing controller unit 200. Here, a still image may be defined as an image in a still state in screens displayed. In an exemplary embodiment, the system unit 100 may provide a control signal CS for controlling an operation of the display unit 300 to the timing controller unit 200.

In an exemplary embodiment, the timing controller unit 200 converts the image signal RGB from the system unit 100, and provides the converted image signal R'G'B' to the display unit 300.

In such an embodiment, the timing controller unit 200 generates a data control signal D-CS and a gate control signal G-CS for controlling an operation of the display unit 300 based on the control signal CS. The timing controller unit 200 provides the data control signal D-CS and the gate control signal G-CS to the display unit 300.

In such an embodiment, the timing controller unit 200 receives the image control signal ICS from the system unit 100. The timing controller unit 200 may reduce overall power consumption of the display device 400 based on the image control signal ICS.

In one exemplary embodiment, for example, when the timing controller unit 200 receives the image control signal ICS from the system unit 100, the timing controller unit 200 may not receive the image signal of the next frame from the system unit 100. In such an embodiment, the timing controller unit 200 may provide the image signal of a previous frame to the display unit 300 instead of providing the image signal of the next frame to the display unit 300. Here, as described above, a still image signal may be generated from the system unit 100 when the same image signal is provided continuously during a predetermined number of frames, where the predetermined number is greater than the reference value.

In such an embodiment, when not receiving the image control signal ICS, the timing controller unit 200 receives the image signal of the next frame from the system unit 100 and then provides the image signal of the next frame to the display unit 300.

As described above, in an exemplary embodiment, the system unit 100 and the timing controller unit 200 use the eDP interface based panel self-Refresh technique. In such an embodiment, when the image control signal ICS is provided to the timing controller unit 200, the system unit 100 does not operate such that overall power consumption of the display device 400 may be reduced.

The display unit 300 includes a display panel 310, a gate driving unit 320 and a data driving unit 330.

The display panel 310 includes a plurality of gate lines G1 to Gn, a plurality of data lines D1 to Dm, and a plurality of pixels PX. The gate lines G1 to Gn extend substantially in a row direction and are arranged along a column direction to intersect the data lines D1 to Dm extending substantially in the column direction.

The pixels PX are connected to the gate lines and the data lines, respectively. In one exemplary embodiment, for example, a pixel PX is connected to a corresponding gate line, e.g., a first gate line G1, and a corresponding data line, e.g., a first data line D1, as shown in FIG. 1. In one exemplary embodiment, for example, each of the pixels PX, e.g., a pixel PX connected to the first gate line G1 and the first data line D1, includes a thin film transistor Tr and a liquid crystal capacitor Clc. The thin film transistor Tr includes a gate electrode connected to the first gate line G1, a source electrode connected to the first data line D1, and a drain electrode connected to the liquid crystal capacitor Clc.

The timing controller unit 200 provides a converted image signal R'G'B' to the data driving unit 310 of the display unit 300. In such an embodiment, the timing controller unit 200 provides the data control signal D-CS to the data driving unit 330 and the gate control signal G-CS to the gate driving unit 320.

The gate driving unit 320 outputs gate signals sequentially in response to the gate control signal G-CS provided from the timing controller unit 200. The pixels PX may be scanned sequentially by a row unit based on the gate signals.

The data driving unit 330 converts the converted image signals R'G'B' into data voltages and outputs the data voltages in response to the data control signal D-CS provided from the timing controller unit 200. The outputted data voltages are provided to the display panel 310.

The pixels PX receive data voltages in response to gate signals. The pixels PX display a gradation or a grayscale corresponding to the data voltages. Accordingly, an image is displayed.

Figure 2:
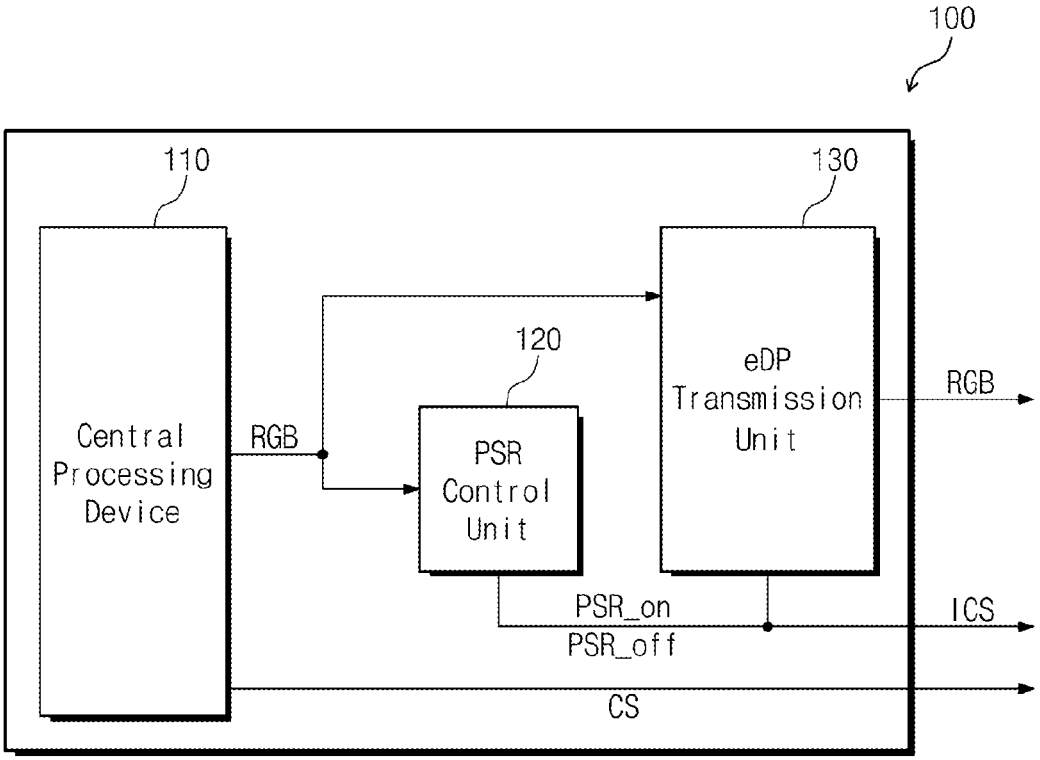
FIG. 2 is a block diagram illustrating an exemplary embodiment of the system unit of FIG. 1.

FIG. 2 is a block diagram illustrating an exemplary embodiment of the system unit of FIG. 1.

Referring to FIG. 2, an exemplary embodiment of the system unit 100 includes a central processing device 110, a panel self-refresh ("PSR") control unit 120 and an eDP transmission unit 130.

The central processing device 110 generates an image signal RGB and a control signal CS of each frame to display an image. In one exemplary embodiment, for example, the central processing device 110 may be implemented with a central processing unit ("CPU") or an application processor ("AP"). The central processing device 110 provides the image signal RGB to the eDP transmission unit 130 and the PSR control unit 120, and delivers the control signal CS to the timing controller unit 200 of FIG. 1.

The PSR control unit 120 receives the image signal RGB of each frame from the central processing device 110. According to an exemplary embodiment of the invention, the PSR control unit 120 may generate a first or second image control signal PSR_on or PSR_off, as the image control signal ICS, by analyzing the image signals RGB for a plurality of frames.

In one exemplary embodiment, for example, the PSR control unit 120 generates the first image control signal PSR_on when the same image signal is provided continuously during a predetermined number of frames, where the predetermined number is greater than the reference value. Then, the PSR control unit 120 generates the second image control signal PSR_off when a new signal other than the same image signal is provided to the central processing device 110. The PSR control unit 120 may provide the first or second image control signal PSR_on or PSR_off to the eDP transmission unit 130 and the timing controller unit 200.

The eDP transmission unit 130 receives the image signal RGB of each frame from the central processing device 110 and the first or second image control signal PSR_on or PSR_off from the PSR control unit 120. The eDP transmission unit 130 may provide the image signal RGB to the timing controller unit 200 based on the first or second image control signal PSR_on or PSR_off.

In an exemplary embodiment, the eDP transmission unit 130 may not provide the image signal RGB to the timing controller unit 200 when receiving the first image control signal PSR_on from the PSR control unit 120. In such an embodiment, the eDP transmission unit 130 may be turned off and the timing controller unit 200 may provide a still image to the display unit 300 of FIG. 1 repeatedly. In such an embodiment, a previous image signal is already stored in the timing controller 200, and the previous image signal corresponding to the still image signal in a current frame is provided to the display unit 300 as a current image signal.

In such an embodiment, the eDP transmission unit 130 may provide the image signal RGB to the timing controller unit 200 when receiving the second image control signal PSR_off from the PSR control unit 120. That is, the eDP transmission unit 130 provides the image signal RGB of each frame generated from the central processing device 110, to the central processing device 110.

In an exemplary embodiment, as described above, when the eDP transmission unit 130 receives the first image control signal PSR_on, the eDP transmission unit 130 may not provide the image signal RGB of the next frame to the timing controller unit 200. In such an embodiment, the eDP transmission unit 130 is turned off when the eDP transmission unit 130 does not provide the image signal RGB of the next frame, such that power consumption may be reduced.

Figure 3:
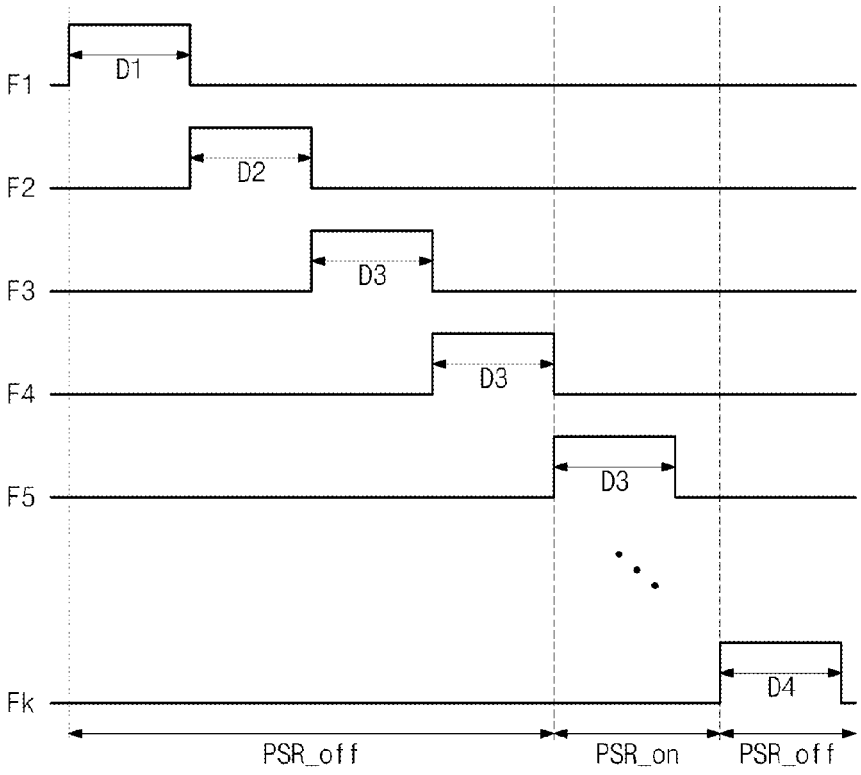
FIG. 3 is a timing diagram illustrating image signals where a first or second image control signal is generated from a panel self-refresh ("PSR") control unit of FIG. 2.

FIG. 3 is a timing diagram illustrating image signals where a first or second image control signal is generated from the PSR control unit of FIG. 2.

Referring to FIGS. 2 and 3, the central processing device 110 transmits a first image signal D1 of a first frame F1 to the PSR control unit 120 and the eDP transmission unit 130. The central processing device 110 transmits a second image signal D2 of a second frame F2 to the PSR control unit 120 and the eDP transmission unit 130. The central processing device 110 transmits a third image signal D3 of a third frame F3 to the PSR control unit 120 and the eDP transmission unit 130. The central processing device 110 transmits the third image signal D3 of a fourth frame F4 to the PSR control unit 120 and the eDP transmission unit 130.

In an exemplary embodiment, as shown in FIG. 3, The PSR control unit 120 may generate a second image control signal PSR_off during the first to fourth frames F1, F2, F3 and F4. In such an embodiment, since a first image control signal PSR_on is not generated, the eDP transmission unit 130 provides the first to third image signals D1, D2 and D3 to the timing controller unit 200 of FIG. 1.

The PSR control unit 120 generates the first image control signal PSR_on when the same image signal is received during a predetermined number of frames, e.g., two successive frames. As shown in FIG. 3, the PSR control unit 120 generates the first image control signal PSR_on as the image signals of the third and fourth frames F3 and F4 are detected as the third image signal D3, that is, the image signals of the third and fourth frames F3 and F4 are substantially the same as each other.

In an exemplary embodiment, the image signal of a frame after the first image control signal PSR_on is generated from the PSR control unit 120 may be the same as the image signal of a frame immediately before a frame in which the first image control signal PSR_on is generated. In such an embodiment, the PSR control unit 120 generates the first image control signal PSR_on when the image signals of two successive frames are substantially the same as each other but the invention is not limited thereto. In an alternative exemplary embodiment, the PSR control unit 120 may generate the first image control signal PSR_on when image signals are the same during a predetermined number of successive frames, e.g., three or four successive frames.

The PSR control unit 120 generates the first image control signal PSR_on as the third image signal D3 is provided during the third and fourth frames F3 and F4. The first image control signal PSR_on is generated continuously until a different image signal, which is a new image signal different from the third image signal D3, is provided. In such an embodiment, the eDP transmission unit 130 is turned off in response to the first image control signal PSR_on.

When the PSR control unit 120 generates the second image control signal PSR_off as the different image signal, e.g., a fourth image signal D4 of a k-th frame Fk, is received, the first image control signal PSR_on is not provided, such that the new image signal, e.g., the fourth image signal D4, is provided to the eDP transmission unit 130.

As described above, in an exemplary embodiment, when the same image signal is continuously received during a predetermined number of frames, the PSR control unit 120 determines that the same image signal is the still image, and performs an operation for reducing power consumption, e.g., turning off the eDP transmission unit 130.

Figure 4:
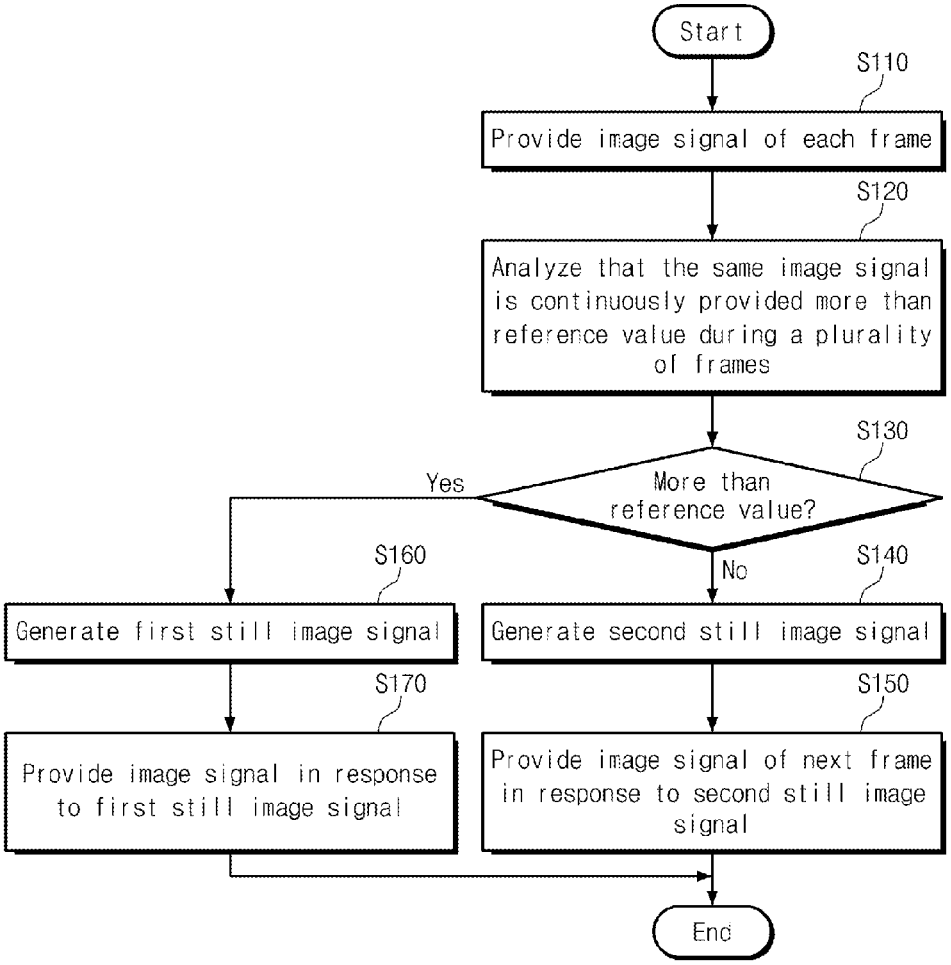
FIG. 4 is a flowchart illustrating an exemplary embodiment of a method of operating the system unit of FIG. 2 to provide an image signal based on a first or second image control signal.

FIG. 4 is a flowchart illustrating an exemplary embodiment of a method of operating the system unit of FIG. 2 to provide an image signal based on a first or second image control signal.

Referring to FIGS. 2 and 4, the central processing device 110 generates an image signal RGB of each frame (S110). The central processing device 110 provides the image signal RGB of each frame to the PSR control unit 120 and the eDP transmission unit 130.

In an exemplary embodiment, the PSR control unit 120 analyzes whether the same image signal is continuously provided during a plurality of frames, and whether the number of the frames, during which the same image signal is continuously provided, is greater than a predetermined value (S120).

In such an embodiment, when the number of frames, during which the same image signal is continuously provided, is not greater than the reference value (S130), the PSR control unit 120 generates the second image control signal PSR_off (S140).

In such an embodiment, the eDP transmission unit 130 receives an image signal RGB of the next frame from the central processing device 110 in response to the second image control signal PSR_off (S150). The eDP transmission unit 130 provides the received image signal RGB of the next frame to the timing controller unit 200 of FIG. 1.

In such an embodiment, when the number of frames, during which the same image signal is provided continuously, is greater than the reference value (S130), the PSR control unit 120 generates the first image control signal PSR_on (S160).

In such an embodiment, the eDP transmission unit 130 is turned off in response to the first image control signal PSR_on (S170). As a result, the eDP transmission unit 130 does not provide the image signal RGB to the timing controller unit 200. That is, as the image signal RGB is not provided from the eDP transmission unit 130, the transmission of the image signal RGB to the outside, which consumes power, may be omitted.

Figure 5:
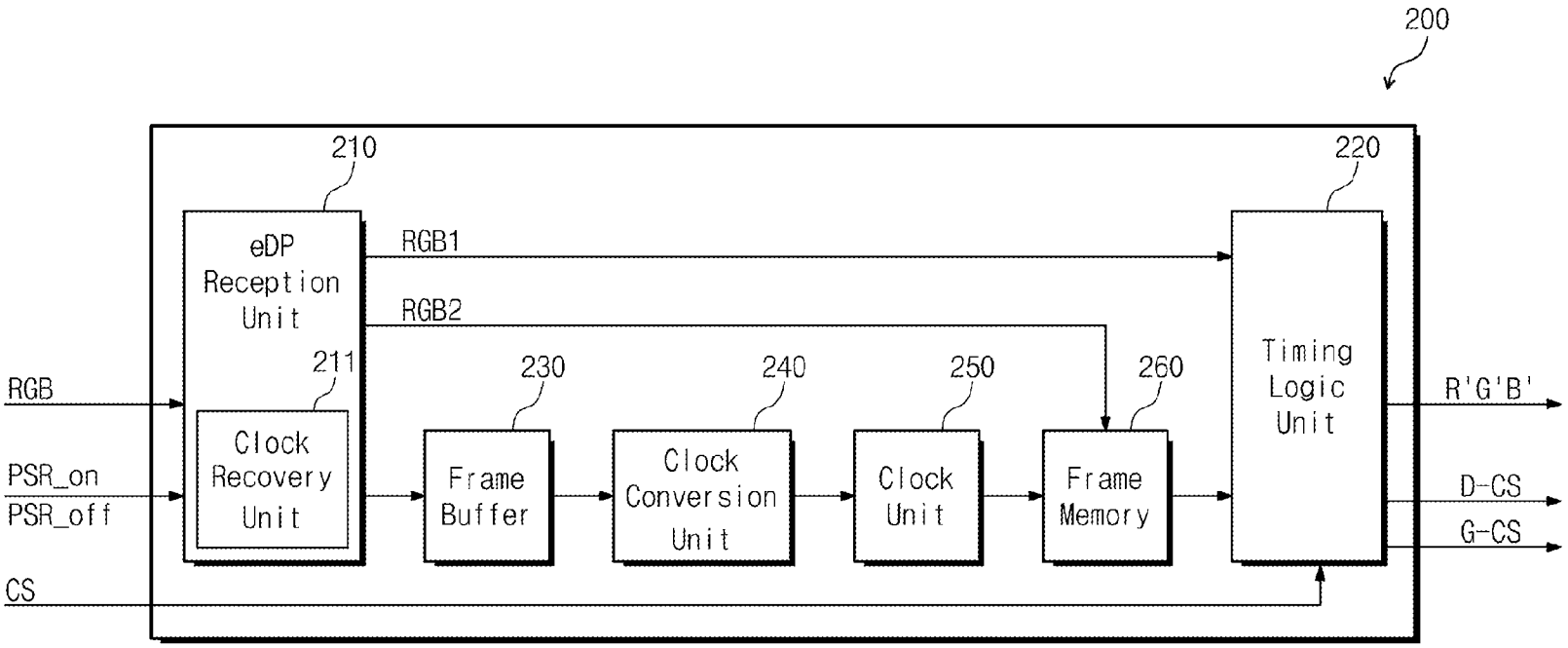
FIG. 5 is a block diagram illustrating an exemplary embodiment of the timing controller unit of FIG. 1.

FIG. 5 is a block diagram illustrating an exemplary embodiment of the timing controller unit of FIG. 1.

Referring to FIGS. 2 and 5, the timing controller unit 200 includes an eDP reception unit 210, a timing logic unit 220, a frame buffer 230, a clock conversion unit 240, and a clock unit 250 and a frame memory 260.

The eDP reception unit 210 receives the image signal RGB of each frame from the eDP transmission unit 130. The eDP reception unit 210 provides a first image signal RGB1 to the timing logic unit 220 in response to the second image control signal PSR_off, and provides a second image signal RGB2 to the frame memory 260 in response to the first image control signal PSR_on. The frame memory 260 provides the second image signal RGB2 to the timing logic unit 220 in synchronization with a clock signal provided from the clock unit 250.

In an exemplary embodiment, the eDP reception unit 210 includes a clock recovery unit 211. The clock recovery unit 211 recovers a clock signal based on the image signal RGB from the eDP transmission unit 130 of FIG. 1. In an exemplary embodiment, the image signal RGB from the eDP transmission unit 130 may be an analog signal. Accordingly, the eDP reception unit 210 recovers the clock signal based on the image signal RGB through the clock recovery unit 211.

In such an embodiment, the eDP reception unit 210 may provide the first image signal RGB1 to the timing logic unit 220 in response to the recovered clock signal when the second image control signal PSR_off is applied. When the second image control signal PSR_off is applied, the eDP reception unit 210 may not provide the second image signal RGB2 to the frame memory 260.

In such an embodiment, the eDP reception unit 210 may provide the second image signal RGB2 to the frame memory 260 when the first image control signal PSR_on is applied. In such an embodiment, the second image signal RGB2 may be the first image signal RGB1 of a frame provided before the first image control signal PSR_on is provided to the eDP reception unit 210.

In such an embodiment, when the first image control signal PSR_on is provided to the eDP reception unit 210, the eDP transmission unit 130 may be turned off, such that the image signal RGB is not provided from the eDP transmission unit 130 to the eDP reception unit 210, and the first image signal RGB1 is thereby not provided to the timing logic unit 220. In such an embodiment, while the first image control signal PSR_on is provided to the eDP reception unit 210, the second image signal RGB2 provided to the frame memory 260 may be continuously provided to the timing logic unit 220.

The timing logic unit 220 converts the data format of the first or second image signal RGB1 or RGB2 received from the eDP reception unit 210 or the frame memory 260 to correspond to the interface specification of the display unit 300 of FIG. 1. The timing logic unit 220 provides the converted image signal R'G'B' to the display unit 300.

In such an embodiment, the timing logic unit 220 generates a gate control signal G-CS and a data control signal D-CS in response to the control signal CS.

The frame buffer 230 stores a clock signal, which is recovered based on the image signal RGB of each frame, from the clock recovery unit 211.

The clock conversion unit 240 generates a new clock signal based on the clock signal stored in the frame buffer 230.

Conventionally, the eDP reception unit 210 transmits the second image signal RGB2 to the frame memory 260 in response to the first image control signal PSR_on. Then, the frame memory 260 transmits the second image signal RGB2 to the timing logic unit 220 based on a clock signal generated from the clock unit 250. Here, the clock signal generated from the clock unit 250 may be an internally fixed clock signal, and the second image signal RGB2 may be the first image signal RGB1 of a frame before a frame in which the first image control signal PSR_on is provided.

When the clock signal of an image signal recovered from the clock recovery unit 211 is different from an internally fixed clock signal, noise may occur in an image signal provided to the timing logic unit 220. More particularly, noise may occur when the frequency of a recovered clock signal of the image signal is different from the frequency of an internally fixed clock signal.

According to an exemplary embodiment of the invention, the timing controller unit 200 includes the clock conversion unit 240 that operates to allow the frequency of the clock signal of an image signal recovered from the clock recovery unit 211 to correspond to the frequency of a clock signal provided from the clock unit 250 to the frame memory 260.

According to an exemplary embodiment of the invention, the clock conversion unit 240 receives clock signals corresponding to a plurality of image signals from the frame buffer 230. The clock conversion unit 240 generates a clock conversion signal based on the clock signals corresponding to the plurality of image signals.

In such an embodiment, the clock conversion unit 240 detects the frequencies of the clock signals corresponding to the plurality of image signals stored in the frame buffer 230. Here, the plurality of image signals may be image signals provided before the first image control signal PSR_on is provided to the eDP reception unit 210. The clock conversion unit 240 calculates an average frequency based on the frequencies of the clock signals corresponding to the plurality of image signals. The clock conversion unit 240 generates a clock conversion signal based on the calculated average frequency.

According to another exemplary embodiment of the invention, the clock conversion unit 240 receives the clock signal of an image signal for a frame immediately before a frame in which the first image control signal PSR_on is provided to the eDP reception unit 210. The clock conversion unit 240 generates a clock conversion signal based on the frequency of the received clock signal.

The clock conversion unit 240 provides the generated clock conversion signal to the clock unit 250.

The clock unit 250 generates a new clock signal to be provided to the frame memory 260 based on the generated clock conversion signal from the clock conversion unit 240. In an exemplary embodiment, the clock unit 250 generates the new clock signal based on the clock signals corresponding to the image signals of previous frames. As a result, the frequency of a clock signal generated from the clock unit 250 may correspond to the frequency of a clock signal based on the second image signal RGB2. Accordingly, the frame memory 260 may provide the second image signal RGB2 to the timing logic unit 220 with reduced noise.

The frame memory 260 provides the second image signal RGB2 to the timing logic unit 220 based on the new cock signal. The frame memory 260 provides the second image signal RGB2 to the timing logic unit 220 continuously until the second image control signal PSR_off is provided to the eDP reception unit 210.

Figure 6:
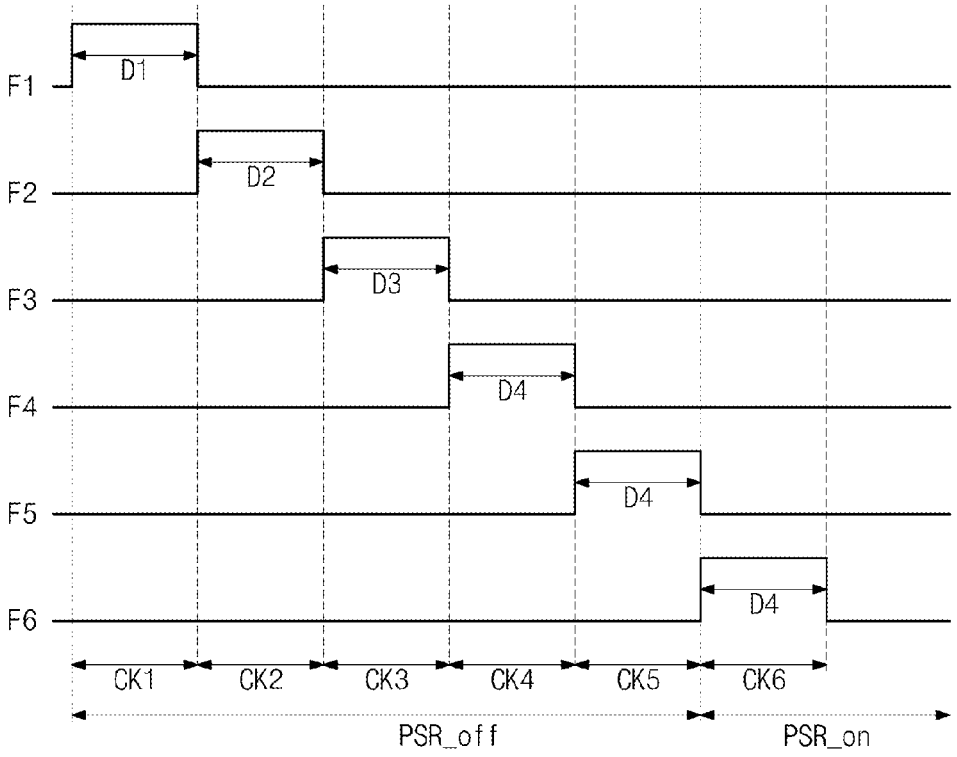
FIG. 6 is a timing diagram illustrating image signals corresponding to clock signals from the clock unit of FIG. 5.

FIG. 6 is a timing diagram illustrating image signals corresponding to clock signals from the clock unit of FIG. 5.

Referring to FIGS. 5 and 6, the clock conversion unit 240 receives first to fifth clock signals CK1, CK2, CK3, CK4 and CK5 corresponding to first to fifth frames F1, F2, F3, F4 and F5 from the frame buffer 230.

In an exemplary embodiment, the first clock signal CK1 may be a clock signal of a first image signal D1 in the first frame F1. The second clock signal CK2 may be a clock signal of a second image signal D2 in the second frame F2. The third clock signal CK3 may be a clock signal of a third image signal D3 in the third frame F3. The fourth clock signal CK4 may be a clock signal of a fourth image signal D4 in the fourth frame F4. The fifth clock signal CK5 may be a clock signal of the fourth image signal D4 in the fifth frame F5. In an exemplary embodiment, as shown in FIG. 6, the same image signal may be provided to the eDP reception unit 210 during the fourth and fifth frames F4 and F5.

As described above with reference to FIG. 3, when the same image signal is generated during the fourth and fifth frames F4 and F5, the second image control signal PSR_off is provided to the eDP reception unit 210. As a result, the eDP reception unit 210 does not provide the image signal for the next frame, i.e., a sixth frame F6, to the timing logic unit 220.

In such an embodiment, when the first image control signal PSR_on is provided to the eDP reception unit 210, the image signal for the sixth frame F6 may be provided from the frame memory 260 to the timing logic unit 220. Here, the image signal of the sixth frame F6 may be the image signal of a previous frame, i.e., the fifth frame F5. In one exemplary embodiment, for example, when the image signal corresponding to the fifth frame F5 is the fourth image signal D4, the image signal corresponding to the sixth frame F6 may be the fourth image signal D4.

In an exemplary embodiment, the clock conversion unit 240 provides a clock conversion signal for determining the clock signal of a new frame to the clock unit 250 when the first image control signal PSR_on is provided to the eDP reception unit 210. In such an embodiment, a sixth clock signal CK6 corresponding to the sixth frame F6 is generated from the clock unit 250 based on the clock conversion signal. The clock unit 250 provides the sixth clock signal CK6 corresponding to the sixth frame F6 to the frame memory 260.

In one exemplary embodiment, for example, the clock conversion unit 240 may generate a clock signal having an average frequency of the frequencies corresponding to the first to fifth clock signals CK1, CK2, CK3, CK4, and CK5 as the sixth clock signal CK6 of the sixth frame F6.

In one exemplary embodiment, for example, the clock conversion unit 240 may generate the fifth clock signal CK5 corresponding to a previous frame, i.e., the fifth frame F5, as the sixth clock signal CK6 of the sixth frame F6.

As described above, in an exemplary embodiment, the frame memory 260 may provide the second image signal RGB2 to the timing logic unit 220 based on a new clock signal corresponding to the clock signal of the second image signal RGB2. In such an embodiment, the frequency of the clock signal based on second image signal RGB2 corresponds to the frequency of a clock signal generated from the clock unit 250, such that an image signal may be provided to the timing logic unit 220.

According to exemplary embodiments of the invention, a display device may use PSR technique such that power consumption is substantially reduced or effectively minimized.

In such embodiments, the driving performance of the PSR technique is substantially improved, and the display device thereby display an image with substantially reduced noise While the invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A display device comprising:

a system unit which outputs a plurality of image signals corresponding to a plurality of frames and outputs a first or second image control signal based on the image signals;

an embedded display port reception unit which receives the image signals and the first or second image control signal from the system unit, provides a still image signal based on the first image control signal and provides the image signals based on the second image control signal; and a frame memory which stores the still image signal from the embedded display port reception unit and outputs the still image signal, wherein the still image signal is one image signal of the image signals;

the embedded display port reception unit recovers first clock signals of the image signals corresponding to the frames; and the frame memory outputs the still image signal based on a second clock signal, wherein the second clock signal has an average frequency which is generated based on frequencies of the first clock signals.

2. The display device of claim 1, wherein the system unit comprises:

a central processing device which provides the image signals to correspond to the frames;

a panel self-refresh control unit which generates the first or second image control signal based on the image signals; and an embedded display port transmission unit which is turned off in response to the first image control signal and provides the image signals to the embedded display port reception unit in response to the second image control signal.

3. The display device of claim 2, wherein the panel self-refresh control unit generates the first image control signal when the image signals received during a predetermined number of consecutive frames are the same as each other.

4. The display device of claim 2, wherein the panel self-refresh control unit generates the second image control signal when the image signals received during a predetermined number of consecutive frames are different from each other.

5. The display device of claim 1, wherein the embedded display port reception unit comprises:

a clock recovery unit which recovers the first clock signals based on the image signals corresponding to the frames while the second image control signal is provided to the embedded display port reception unit.

6. The display device of claim 1, further comprising:

a frame buffer which stores the first clock signals corresponding to the image signals while the second image control signal is provided to the embedded display port reception unit.

7. The display device of claim 6, further comprising:

a clock conversion unit which generates a clock conversion signal based on the first clock signals stored in the frame buffer.

8. The display device of claim 7, further comprising:

a clock unit which generates the second clock signal based on the clock conversion signal, wherein the frame memory provides the still image signal based on the second clock signal.

9. The display device of claim 1, further comprising:

a timing logic unit which receives the image signals from the embedded display port reception unit and receives the still image signal from the frame memory, wherein the timing logic unit converts a data format of the image signals or the still image signal, based on a control signal from the system unit.

10. The display device of claim 9, further comprising:

a display unit which displays an image based on the converted image signals or the converted still image signal from the timing logic unit.

11. The display device of claim 1, wherein when the first image control signal is provided to the embedded display port reception unit, the frame memory stores an image signal of a frame, which is provided to the embedded display port reception unit before the first image control signal is provided thereto.

12. The display device of claim 1, wherein the first image signals are in synchronization with the first clock signal.

13. The display device of claim 1, wherein the frame memory always stores the still image signal from the embedded display port reception unit and outputs the still image signal when the image signals received during a predetermined number of consecutive frames are the same as each other.

14. A method of driving a display device, the method comprising:

outputting a plurality of image signals corresponding to a plurality of frames and a first and second image control signal from a system unit to an embedded display port reception unit of the display device;

providing a still image signal from the embedded display port reception unit to a display unit of the display device based on the first image control signal; and providing the image signals to the display unit based on the second image control signal, wherein the still image signal is one image signal of the image signals;

first clock signals are recovered based on the image signals corresponding to the frames; the still image signal is outputted based on a second clock signal; and the second clock signal has an average frequency which is generated based on frequencies of the first clock signals.

15. The method of claim 14, wherein the second clock signal is generated based on an average frequency calculated based on frequencies of the first clock signals.

16. The method of claim 14, wherein the frame memory always stores the still image signal from the embedded display port reception unit and outputs the still image signal when the image signals received during a predetermined number of consecutive frames are the same as each other.

* * * * *